US005133487A

United States Patent [19]

Russi

[11] Patent Number: 5,133,487

[45] Date of Patent: Jul. 28, 1992

[54] DISPENSER FOR STORING AND DISPENSING FLUENT MATERIALS

[75] Inventor: Luciano Russi, Udine, Italy

[73] Assignee: Giannino Sandrin, Pordenone, Italy

[21] Appl. No.: 700,867

[22] Filed: May 16, 1991

[30] Foreign Application Priority Data

May 17, 1990 [IT] Italy ..... 83386/ A/90

[51] Int. Cl.[5] ..... A47L 15/00

[52] U.S. Cl. ..... 222/651; 222/54; 222/129; 134/93; 68/17 R

[58] Field of Search ..... 222/638, 651, 504, 129, 222/54; 134/93; 68/17 R, 207

[56] References Cited

U.S. PATENT DOCUMENTS

| | | | |
|---|---|---|---|
| 2,861,581 | 11/1958 | Ryckman, Jr. | 134/93 X |
| 2,973,769 | 3/1961 | Jacobs et al. | 222/651 X |
| 3,028,051 | 4/1962 | Jacobs | 222/651 X |
| 3,094,247 | 6/1963 | Marchi | 222/54 |
| 3,160,319 | 12/1964 | Patzelt et al. | 222/54 |
| 3,233,782 | 2/1966 | Ullman, Jr. et al. | 134/93 X |
| 3,310,203 | 3/1967 | McCann | 222/54 |
| 3,351,239 | 11/1967 | Flock | 222/54 |
| 3,406,695 | 10/1968 | Perl | 222/651 X |
| 3,584,763 | 6/1971 | Donselman | 222/54 |
| 3,739,942 | 6/1973 | Mercer et al. | 222/54 |

*Primary Examiner*—Donald T. Hajec

*Assistant Examiner*—Anthoula Pomrening

*Attorney, Agent, or Firm*—Wenderoth, Lind & Ponack

[57] ABSTRACT

A dispenser stores and dispenses two fluent materials, such as detergent and rinse aid in a clothes washer or diswashing machine. The dispenser has a hollow casing defining a pair of discrete storage reservoirs for accommodating the detergent and rinse aid. The detergent and rinse aid are released from the dispenser under the operation of a thermomagnetic mechanism. The thermomagnetic mechanism includes a first lamellar element of an electrically conductive alloy having a Cuurie-point, a second electrically conductive element, and an electrically energizable heating element interposed between the first and second elements. The actuator includes a permanent magnet and a release mechanism to which either the permanent magnet or the thermomagnetic mechanism is mounted. An attractive force between the permanent magnet and thermomognetic mechanism maintains the release mechanism in a position in which the detergent and/or rinse aid is confined within a respective storage reservoir. On the other hand, when the heating element heats the first lamellar element to above its Curie-point, the first element loses its magnetic characteristic and the permanent magnet is no longer attracted thereto. In this case, the release mechanism allows the detergent and/or rinse aid to flow from the dispenser.

30 Claims, 2 Drawing Sheets

DISPENSER FOR STORING AND DISPENSING FLUENT MATERIALS

BACKGROUND OF THE INVENTION

1. Field of the Invention

The present invention relates to a dispenser for storing and automatically dispensing fluent materials.

More particularly, the present invention relates to a dispensing apparatus featuring a thermomagnetic mechanism which when actuated causes fluid materials stored in the apparatus to be dispensed in predetermined amounts under a preset timing.

The present invention may be advantageously used in, but is not limited to use in, clothes washing machines and dishwashers for automatically adding detergents and rinse aids during the operating cycles thereof.

2. Description of the Related Art

Detergent and rinse aid dispensers for use in household and industrial washing machines, to which reference will be made by way of example hereinafter, are widely known in the prior art.

These prior art dispensers have various types of actuating means for automatically dispensing detergent and/or rinse aid. These actuating means in turn adopt various release mechanisms to displace or release a single part or a subassembly of the dispenser under the command of a typically electric control mechanism.

Usually detergent is stored in an appropriate reservoir in the dispenser. A gate or lid acts to confine the detergent within the reservoir. When the detergent is required to be dispensed, an electric pulse is issued to the gate or lid so as to open the same, thereby enabling the detergent to flow into the washing tub or tank.

Similarly, rinse aid is confined in an appropriate reservoir by an electrically actuatable valve. Therefore, when the rinse aid is required to be dispensed, an electric pulse is issued to the valve causing the valve to open so that the liquid rinse aid is allowed to flow into the washing tub or tank.

There are primarily three types of actuating means used in the prior art to carry out the above-described functions:

(a) electromagnetic, whereby actuation is effected by the displacement of a movable iron core in a solenoid when an electric pulse is issued thereto;

(b) thermomechanical, whereby the actuation occurs through the displacement of a pin extending from an enclosure filled with wax with a water-tight seal established therebetween; the wax is expanded to move the pin by raising the temperature of the wax with a thermistor, a PTC (Positive Temperature Coefficient) device, or an electric heating element;

(c) bimetal element, whereby the actuation occurs by heating the bimetal element with an electric heating element, a PTC device or a thermistor.

Electromagnetic systems are quite expensive. Furthermore, they are prone to failure to due to winding faults and they can be quite noisy (clattering) during operation.

Thermomechanical systems are also expensive and may experience defects in the water-tight seal between the pin and wax-filled enclosure.

On the other hand, bimetal systems are relatively simple. However, they are subject to a number of application-related problems, since their component parts are sensitive to room temperature and other variable conditions.

SUMMARY OF THE INVENTION

An object of the present invention is to provide the dispenser which will obviate all of the problems encountered in the prior art dispensing systems described above.

To achieve this object, the present invention provides a dispenser in which the actuating means for automatically dispensing the fluent material includes a thermomagnetic mechanism.

Preferably, thermomagnetic mechanism includes a magnetic element of an Invar type, i.e. a nickel and iron alloy.

Such an alloy has a distinctive feature in that at a certain temperature (Curie-point) which is a function of the nickel content in the alloy, it loses its magnetic property and becomes nonmagnetic.

The actuating means also includes a permanent magnet disposed in an operative relational association with the thermomagnetic mechanism. This relational association is one in which no dispensing of the fluent material will take place as long as the temperature of the thermomagnetic mechanism remains below a certain value, whereby the thermomagnetic mechanism exhibits a magnetic characteristic which will cause an attraction between the permanent magnet and the thermomagnetic mechanism.

However, when the thermomagnetic mechanism is heated to above a certain temperature (Curie-point), the thermomagnetic mechanism loses its magnetic characteristic whereby the permanent magnet will no longer be attracted thereto. This in turn will cause the detergent and/or rinsing aid to be dispensed into the washing machine.

Preferably, the thermomagnetic mechanism is heated by a thermistor or PTC device having highly reliable operating characteristics.

BRIEF DESCRIPTION OF THE DRAWINGS

These and other objects, features and advantages of the present invention will be described in more detail below, by way of preferred but non-limiting embodiments, with reference to the accompanying drawings, in which.

DETAILED DESCRIPTION OF THE PREFERRED EMBODIMENTS

Figure 1:
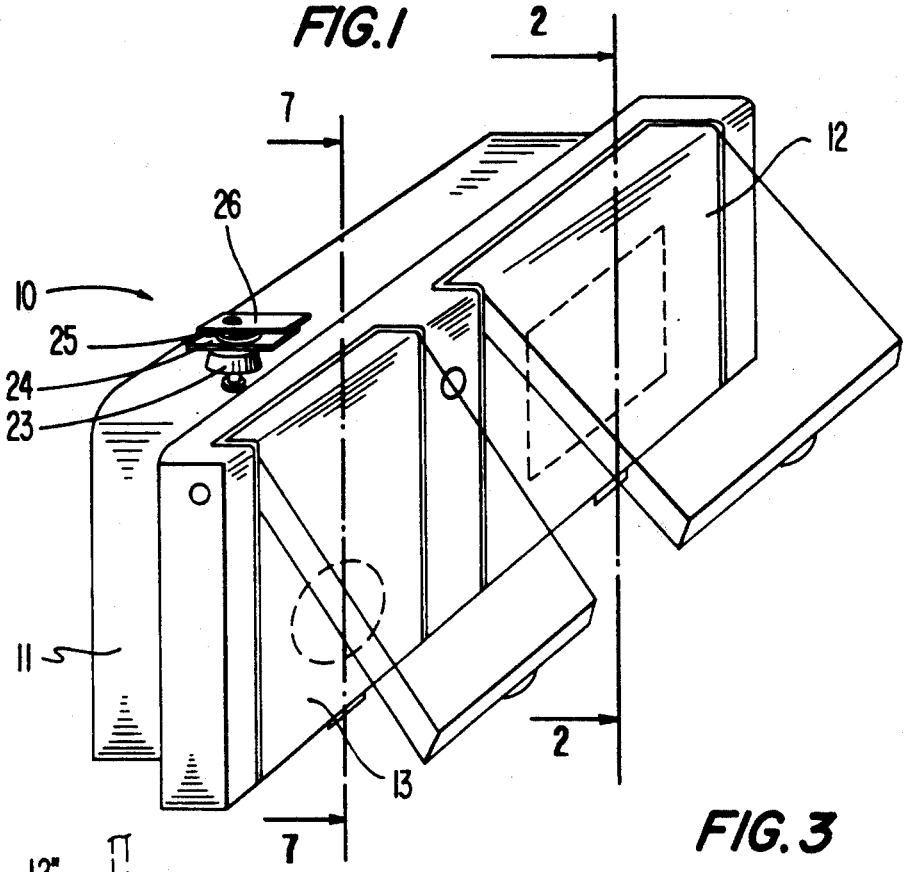
FIG. 1 is a schematic, perspective view of a dispenser according to the present invention.

FIG. 1 illustrates the dispenser 10 of the present invention which has, like prior art devices of this type, a box-like hollow casing 11 of generally thermoplastic material.

The hollow casing 11 has a first lid 12 movably mounted thereto, which is opened automatically in a manner described in more detail below to facilitate the dispensing of detergent when an electrical pulse is issued from a suitable timer.

On the other hand, a second lid 13 is also movably mounted to the hollow casing 11, but is to be manually opened by a user in order to fill the dispenser with rinsing aid.

Figure 2:
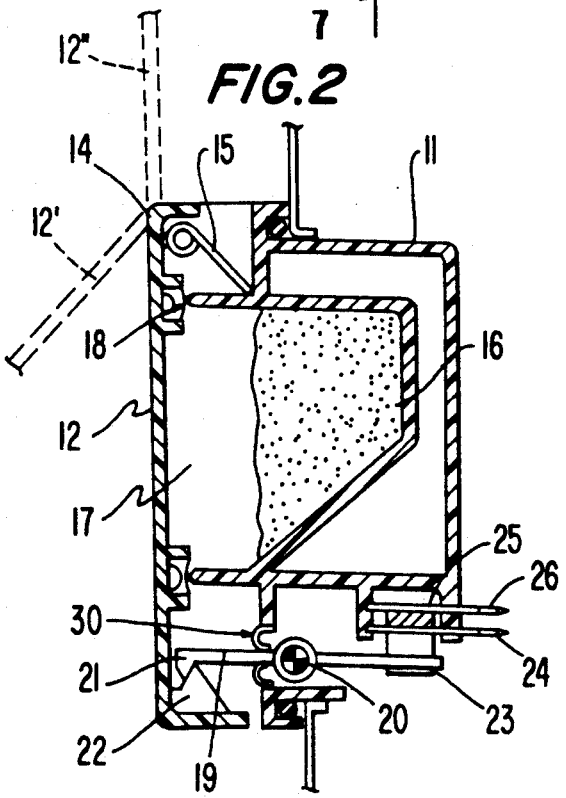
FIG. 2 is a cross-sectional view of the dispenser taken along lines 2—2 in FIG. 1, showing a state in which the dispenser is not dispensing detergent.

As shown in FIG. 2, the first lid 12 is pivotably connected to the casing 11 about fulcrum 14. The lid 12 is biased by spring 15 from the full position shown in solid lines to an open position. When the lid 12 is released from the closed position, the spring 15 moves the lid 12 to the open position indicated by reference numeral 12" through the various intermediate positions one of which is indicated by reference numeral 12'. The hollow casing 11 defines a first storage reservoir 17 therein in which a supply of detergent 16 is accommodated. A gasket 18 provides a seal between the lid 12 and the storage reservoir 17.

The actuating means for automatically dispensing the detergent stored in reservoir 17 by releasing the lid 12 from its closed position will now be described in more detail below.

A release mechanism in the form of a latch 19 maintains the lid 12 in the closed position. The latch 19 is pivotably mounted through a pin 20 to the casing 11 at a location intermediate opposite ends of the latch, whereby the latch 19 is able to swing about the pin 20. One of the ends 21 of the latch 19 has a toothed configuration engageable with a portion 22 of the first lid 12 defining a notch.

A permanent magnet 23 of the actuating means is mounted to the other end of the latch 20.

The permanent magnet 23 is attracted to a thermomagnetic mechanism so as to maintain the lid 12 in its closed position owing to the engagement of the toothed end 21 of the latch 19 with the notched portion 22 of the lid 12.

The thermomagnetic mechanism includes a first lamellar element 24 of an electrically conducted alloy having a Curie-point, a second element 26 of an electrically conductive material, and an electrically energizable heating element 25 interposed between the lamellar element 24 and the second element 26. These elements of the thermomagnetic mechanism are fixed to the casing 11.

The first lamellar element 24 is a thin metal plate of an iron-nickel alloy. The lamellar element 24 keeps the lid 12 in its normally closed position by exhibiting a magnetic characteristic which causes the permanent magnet 23 to be attracted thereto. This magnetic characteristic is exhibited until the temperature of the thin metal plate of the first lamellar element 24 is raised above its Curie-point.

The second element 26 can also be a lamellar element and preferably is of brass or bronze.

The first lamellar element 24 can be heated by the heating element 25 comprising either a thermistor or a PTC element. The heating element 25 is electrically energized by applying a predetermined voltage potential to the first 24 and second 26 elements with a power source schematically illustrated by reference numeral 27.

By thus causing electric current to flow through the electrically energizable heating element interposed between the first 24 and second 26 elements, the heating element 25 is energized to heat the first lamellar element 24 above its Curie-point. Consequently, the first lamellar element 24 becomes nonmagnetic.

Figure 3:
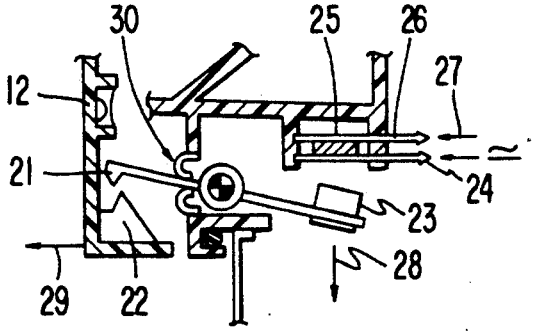
FIG. 3 is a detailed view of the actuating means shown in FIG. 2.

As shown in FIG. 3, when the first lamellar element 24 becomes nonmagnetic, the release mechanism (latch 19) moves from a first position thereof at which the release mechanism acted to confine the detergent in the reservoir 17 to a second position at which the detergent 16 can flow from the dispenser. Specifically, as indicated by arrow 28, when the permanent magnet 23 is released from the thin metal plate of the first lamellar element 24, the toothed end 21 of the latch 19 is disengaged from the notched portion 22 of the lid. Thus, the lid 12 is set free and is opened in the direction shown by arrow 29 under the biasing force exhibited by spring 15.

In both FIGS. 2 and 3, reference numeral 30 designates a seal, e.g. a rubber gasket, between the end of the latch 19 to which the permanent magnet 23 is fixed and an opening in the casing 11 covered by the lid 12. The seal allows the lever 19 to pivot about the pin 20 but at the same time protects the thermomagnetic mechanism against splashing water.

Figure 4:
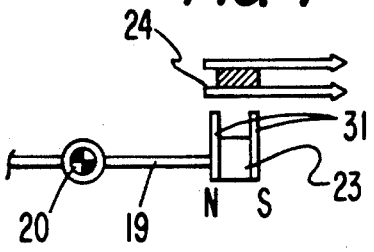
FIG. 4 is a detailed view of an alternative embodiment of actuating means according to the present invention.

In the alternative form shown in FIG. 4, the permanent magnet is provided with ferrous pole pieces 31 so as to ensure the attraction between the magnet 23 and the iron-nickel first lamellar element 24.

Figure 5:
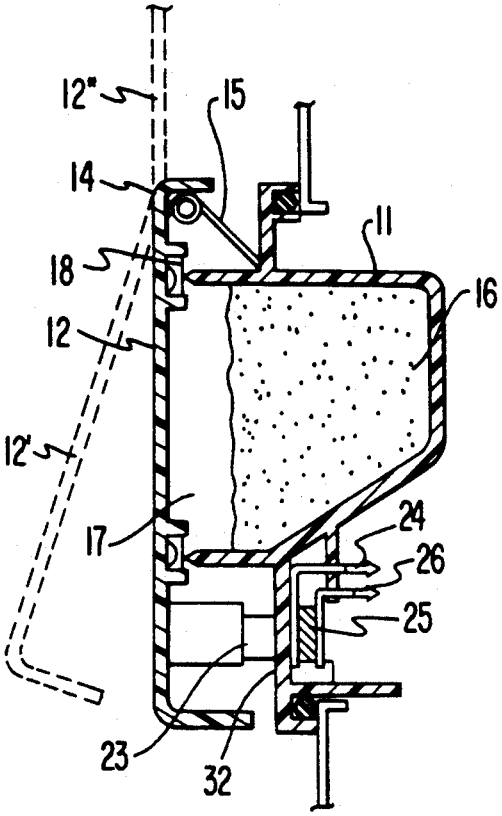
FIG. 5 is a cross-sectional view of the dispenser similar to that of FIG. 2 but showing an alternative embodiment of the dispenser according to the present invention.
Figure 6:
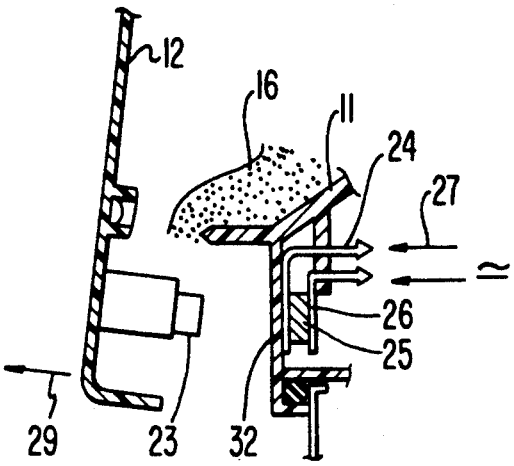
FIG. 6 is a detailed view of the actuating means shown in FIG. 5, in a state in which detergent is being dispensed.

In the embodiment shown in FIGS. 5 and 6, the release mechanism consists of the lid 12 itself which is movable from the first position shown in solid lines at which the lid 12 confines the detergent 16 within the reservoir 17 and a second position indicated by reference numeral 12" in which the lid 12 allows the detergent 16 in the reservoir 17 to flow from the dispenser.

In this embodiment, the permanent magnet 23 is directly mounted on the lid 12. Although a wall 32 is interposed between the permanent magnet 23 and the thermomagnetic mechanism so as to protect the thermomagnetic mechanism against splashing water, the permanent magnet 23 nonetheless cooperates with the thermomagnetic mechanism in the manner similar to that described above with respect to the first embodiment.

Figure 7:
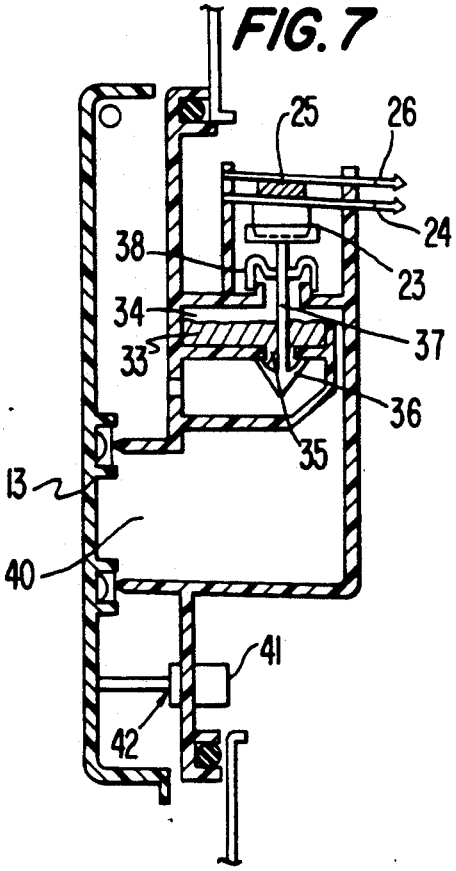
FIG. 7 is a cross-sectional view of the dispenser of FIG. 1 taken along lines 7—7, showing the state in which the dispenser is not dispensing rinsing aid.

Referring now to FIG. 7, liquid rinse aid 33 is accommodated within a second storage reservoir 34. The second storage reservoir has an outlet opening 35 located at the bottom thereof. In this case, the release mechanism is in the form of a lip-seal valve 36 of elastomeric material.

The permanent magnet 23 is fixed to a stem 37 of the valve 36. Permanent magnet 23 cooperates with the first lamellar element 24 of the thermomagnetic mechanism in a manner similar to that described above.

Figure 8:
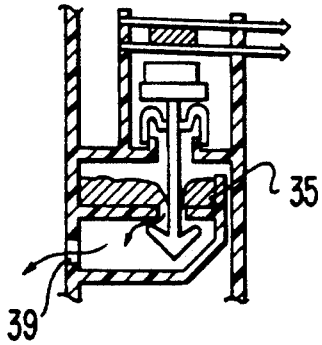
FIGS. 8 and 9 are, respectively, detailed views of respective portions of the dispenser shown in FIG. 7, in a state in which rinsing aid is being dispensed.
Figure 9:
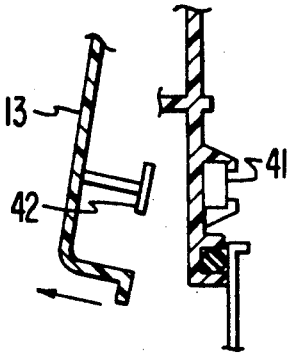

Specifically, the release mechanism (lip-seal valve 36) is movable from a first position shown in FIG. 7 in which the release mechanism acts to confine the liquid rinse aid within the storage reservoir 34 and a second position shown in FIG. 8 at which the release mechanism allows the rinse aid to flow from the casing 11.

That is to say, when the first lamellar element 24 is below its Curie-point, the permanent magnet 23 is attracted thereto whereby the lip-seal valve 36 blocks the outlet opening 35. On the other hand, when current is passed through the heating element 25 via the thin plates of the first 24 and second 26 elements which project from the casing, such that the first lamellar element 24 is heated to above its Curie-point, the first lamellar element 24 no longer exhibits a magnetic characteristic whereupon the lip-seal valve 36 drops under gravity so as to unblock the outlet opening 35. It is to be noted that reference numeral 38 designates a sealing retainer made of elastomeric material.

When the valve 36 is allowed to drop to the position shown in FIG. 8, and the outlet opening 35 is unblocked, the rinse aid can flow through an orifice 39 into the washing tub or tank. It is to be noted that the orifice 39 is in communication with the washing tub or tank through a channel in the casing (not shown).

The second lid 13 is only opened occasionally by the user when the need arises to refill the second storage reservoir with liquid rinse aid. This can be accomplished by filling the reservoir 34 through a filling space 40 covered by the lid 13.

The second lid is maintained in a closed position by a magnet 41 fixed to the casing and a ferrous plate 42 fixed to the lid 13. The positions of the magnet 41 and ferrous plate 42 can of course be reversed. In such a way, the filling space 40 is constantly kept covered and is assuredly sealed.

It should be noted that although the permanent magnet has been described as being fixed to the moving release mechanism, the permanent magnet 23 may otherwise be fixed to the casing 11. In such a case, the elements 24, 25, and 26 of the thermomagnetic mechanism are connected to the release mechanism.

Finally, it should be noted that various other changes and modifications will become apparent to those of ordinary skill in the art reviewing the detailed description above. It is to be understood therefore, that such changes and modifications may be employed without departing from the spirit of the invention as defined by the scope of the appended claims.

What is claimed is:

1. A dispenser for storing and dispensing fluent material, said dispenser comprising:

a hollow casing defining a storage reservoir therein for accommodating a supply of fluent material; and actuating means for automatically dispensing fluent material stored in said reservoir from said hollow casing, said actuating means comprising a release mechanism mounted to said casing and movable relative thereto from a first position at which the release mechanism acts to confine fluent material in said reservoir and a second position at which the release mechanism acts to allow fluent material in said reservoir to flow from said casing, a permanent magnet fixed to one of said casing and the release mechanism of said actuating means, and thermomagnetic mechanism means fixed to the other of said casing and the release mechanism of said actuating means and in operative relational association with said permanent magnet for selectively exhibiting a magnetic characteristic which will cause an attraction between the magnet and the thermomagnetic mechanism means, said thermomagnetic mechanism means including a first lamellar element of an electrically conductive alloy having a Curie-point, a second element of an electrically conductive material, and an electrically energizable heating element interposed between said first and said second elements, whereby when a predetermined voltage potential is applied to said first and second elements, said heating element is energized to heat said lamellar element above the Curie-point thereof.

2. A dispenser as claimed in claim 1, wherein said first element is of an iron-nickel alloy and said second element is one of brass and bronze.

3. A dispenser as claimed in claim 2, wherein said heating element is a thermistor.

4. A dispenser as claimed in claim 2, wherein said heating element is a PTC element.

5. A dispenser as claimed in claim 1, wherein said heating element is a thermistor.

6. A dispenser as claimed in claim 1, wherein said heating element is a PTC element.

7. A dispenser as claimed in claim 1, wherein said permanent magnet is fixed to said release mechanism.

8. A dispenser as claimed in claim 7, wherein said actuating means further includes a lid movably mounted to said casing over said storage reservoir, said lid having a portion thereof defining a notch, and said release mechanism is a latch having opposite ends and pivotably mounted to said casing at a location intermediate the ends thereof, one of the ends of said latch having a toothed configuration engageable with the notched portion of said lid, said permanent magnet being mounted to the other of the ends of said latch.

9. A dispenser as claimed in claim 8, and further comprising sealing means for providing a seal between the end of said latch to which the permanent magnet is fixed and an opening in said casing covered by said lid.

10. A dispenser as claimed in claim 7, wherein said release mechanism includes a lid movably mounted to said casing over said storage reservoir, said permanent magnet being mounted to said lid.

11. A dispenser as claimed in claim 7, wherein said storage reservoir has an outlet opening, and said release mechanism is a valve movable between respective positions at which the valve blocks and unblocks said outlet opening, said permanent magnet being mounted to said valve.

12. A dispenser as claimed in claim 11, and further comprising a lid movably mounted to said casing and a latching mechanism means for detachably maintaining said lid in a closed position, said latching mechanism means including a ferrous plate mounted to one of said lid and said casing, and another permanent magnet mounted to the other of said lid and said casing.

13. A dispenser as claimed in claim 1, wherein said permanent magnet is fixed to said casing.

14. A dispenser as claimed in claim 1, wherein said permanent magnet is provided with ferrous pieces of material serving as magnetic poles.

15. A dispenser as claimed in claim 1, wherein said casing has a wall interposed between said permanent magnet and said thermomagnetic mechanism means.

16. A dispenser for storing and dispensing two fluent materials, said dispenser comprising:

a hollow casing defining a pair of discrete storage reservoirs therein for accommodating two supplies of fluent material, respectively; and actuating means for automatically dispensing fluent material stored in each of said reservoirs from said hollow casing, said actuating means comprising a respective release mechanism associated with each of said reservoirs mounted to said casing and movable relative thereto from a first position at which the release mechanism acts to confine fluent material in a respective said reservoir and a second position at which the release mechanism acts to allow fluent material in said respective reservoir to flow from said casing, a permanent magnet fixed to one of said casing and a said respective release mechanism of the actuating means, and thermomagnetic mechanism means fixed to the other of said casing and said respective release mechanism of said actuating means and in operative relational association with said permanent magnet for selectively exhibiting a magnetic characteristic which will cause an attraction between the magnet and the thermomagnetic mechanism means, said thermomagnetic mechanism means including a first lamellar element of an electrically conductive alloy having a Curie-point, a second element of an electrically conductive material, and an electrically energizable heating element interposed between said first and said second elements, whereby when a predetermined voltage potential is applied to said first and second elements, said heating element is energized to heat said lamellar element above the Curie-point thereof.

17. A dispenser as claimed in claim 16, wherein said first element is of an iron-nickel alloy and said second element is one of brass and bronze.

18. A dispenser as claimed in claim 17, wherein said heating element is a thermistor.

19. A dispenser as claimed in claim 17, wherein said heating element is a PTC element.

20. A dispenser as claimed in claim 16, wherein said heating element is a thermistor.

21. A dispenser as claimed in claim 16, wherein said heating element is a PTC element.

22. A dispenser as claimed in claim 16, wherein said permanent magnet is fixed to a said release mechanism.

23. A dispenser as claimed in claim 22, wherein said actuating means includes a lid movably mounted to said casing over one of said storage reservoirs, said lid having a portion thereof defining a notch, and a said release mechanism is a latch having opposite ends and pivotably mounted to said casing at a location intermediate the ends thereof, one of the ends of said latch having a toothed configuration engageable with the notched portion of said lid, and wherein said permanent magnet is mounted to the other of the ends of said latch.

24. A dispenser as claimed in claim 23, and further comprising sealing means for providing a seal between the end of said latch to which the permanent magnet is fixed and an opening in said casing covered by said lid.

25. A dispenser as claimed in claim 22, wherein a respective said release mechanism includes a lid movably mounted to said casing over one of said storage reservoirs, said permanent magnet being mounted to said lid.

26. A dispenser as claimed in claim 22, wherein said storage reservoir has an outlet opening, and said respective release mechanism is a valve movable between respective positions at which the valve blocks and unblocks said outlet opening, said permanent magnet being mounted to said valve.

27. A dispenser as claimed in claim 26, and further comprising a lid movably mounted to said casing and a latching mechanism means for detachably maintaining said lid in a closed position, said latching mechanism means including a ferrous plate mounted to one of said lid and said casing, and another permanent magnet mounted to the other of said lid and said casing.

28. A dispenser as claimed in claim 22, wherein said permanent magnet is fixed to said casing.

29. A dispenser as claimed in claim 22, wherein said permanent magnet is provided with ferrous pieces of material serving as magnetic poles.

30. A dispenser as claimed in claim 22, wherein said casing has a wall interposed between said permanent magnet and said thermomagnetic mechanism means.

* * * * *